United States Patent [19]

Carson, Jr. et al.

[11] 4,112,536

[45] Sep. 12, 1978

[54] APPLICATOR

[75] Inventors: John C. Carson, Jr., Manasquan Park; Clarence R. Robbins, Piscataway; Divaker B. Kenkare, South Plainfield, all of N.J.

[73] Assignee: Colgate-Palmolive Company, New York, N.Y.

[21] Appl. No.: 852,348

[22] Filed: Nov. 17, 1977

Related U.S. Application Data

[63] Continuation of Ser. No. 647,932, Jan. 9, 1976, abandoned.

[51] Int. Cl.[2] ..... B05C 17/00

[52] U.S. Cl. ..... 15/104.94; 15/231; 401/208

[58] Field of Search ..... 118/257, 260; 401/208; 206/205; 15/104.93, 104.94, 231

[56] References Cited

U.S. PATENT DOCUMENTS

| | | | |
|---|---|---|---|
| 146,383 | 1/1874 | Coutant | 118/257 |
| 818,692 | 4/1906 | Jackson | 118/257 |
| 1,399,734 | 12/1921 | Baldwin | 118/257 X |
| 1,705,450 | 3/1929 | Mullen | 118/257 |
| 1,985,790 | 12/1934 | Maier | 118/257 |
| 2,057,085 | 10/1936 | Danco | 401/208 |
| 2,688,305 | 9/1954 | Wray et al. | 118/257 X |
| 3,441,353 | 4/1969 | Claff | 401/208 X |
| 3,690,252 | 9/1972 | Sokolov | 118/257 X |

*Primary Examiner*—John P. McIntosh

*Attorney, Agent, or Firm*—Strauch, Nolan, Neale, Nies & Kurz

[57] ABSTRACT

Apparatus for dispensing a fluent composition comprising a casing having a top opening with a stationary or rotatable arcuately surfaced web backing member projecting through the opening and a carrier web bearing the composition passes out of the casing through the opening at one side of the member to closely overlie the member and present a firmly backed convex applicator area outside said casing and then passes back into said casing along the other side of said member. In the preferred embodiments the used areas of the web are rewound within the casing, which may be disposable.

5 Claims, 6 Drawing Figures

APPLICATOR

This is a continuation of application Ser. No. 647,932, filed Jan. 9, 1976, now abandoned.

The invention relates to non-aerosol applicators for more or less personal use, as for sapplying deodorants, antiperspirants and the like free flowing liquids or pastes to areas of the body, and it is particularly directed to applicators wherein the composition to be applied is distributed in or on a carrier web that is movable from an internal supply over a smoothly contoured backing surface to selectively dispose fresh application areas in exposed operative location.

The invention lies in the field wherein today most antiperspirants and deodorants are conventionally applied by aerosol and other sprays, roll-on devices, impregnated individual tissues and pads, squeeze bottles and flexible walled tubes. Various problems encountered with these devices are that they may be messy to use, unsanitary or inconvenient, or environmentally objectionable as in the case of the aerosols. The present invention provides for safe, advantageously sanitary, easy to use and efficient application of fluent compositions.

The invention contemplates an applicator of novel structure and mode of operation wherein a composition to be dispensed is incorporated in or on a carrier web within a casing and sequential areas of the web may be moved out of the casing to exposed applicator position overlying an external smoothly contoured backing surface on the casing.

Another advantageous feature of the invention is the provision of the novel applicator structure wherein a roll or like supply of a web impregnated with or otherwise carrying a composition to be dispensed is rotatably mounted within a casing that has an external smoothly contoured surface over which the leading end of the web is passed and is selectively positioned, there preferably being a rewind or like used web area accummulation station within the casing. Pursuant to this feature, supply and rewind rolls of the web within the casing have special rotation controls such as unidirectional ratchets or friction devices so that the web may be kept wrinkle-free and preferably under slight tension.

Further novel and advantageous features will appear as the description proceeds in connection with the appended claims and the accompanying drawings.

PREFERRED EMBODIMENTS

Figure 1:
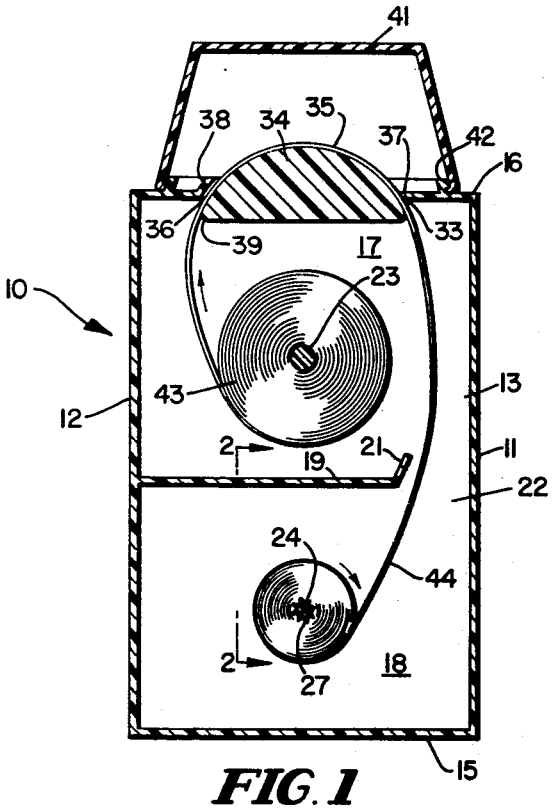
FIG. 1 is a side elevation in section showing a preferred embodiment of the invention.
Figure 2:
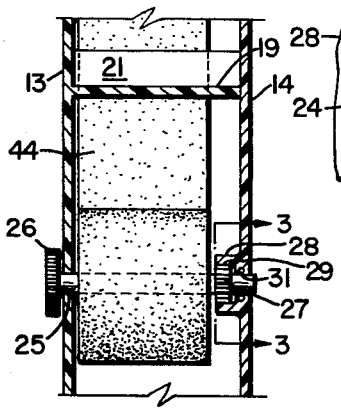
FIG. 2 is a fragmentary section substantially on line 2—2 in FIG. 1 showing internal detail.
Figure 3:
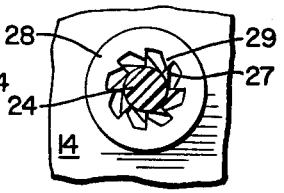
FIG. 3 is a fragmentary section substantially on line 3—3 of FIG. 2 showing the unidirectional ratchet on the take-up spindle.

Referring to FIGS. 1–3, a casing 10 comprises a front wall 11, rear wall 12, opposite side walls 13 and 14, bottom wall 15 and a top wall 16. Internally the casing is effectively separated into upper and lower chambers 17 and 18 of about the same size by an internal transverse wall 19 that extends laterally between walls 13 and 14 as shown in FIG. 2 and forwardly from rear wall 12 as shown in FIG. 1 and terminates in an upwardly forwardly inclined lip 21 adjacent front wall 11 to define with wall 11 a transverse slot 22 providing communication between the chambers.

In practice it has been found desirable to mold walls 11, 12, 13, 15, 16 and 19 as an integral synthetic plastics element, and to attach thereto a separately formed synthetic plastics side wall 14 as this has proved particularly advantageous for assembly.

A supply reel spindle 23 is rotatably mounted in chamber 17, and a take-up spindle 24 is rotatably mounted in chamber 18. The spindles have parallel axes, are preferably journalled in the opposite side walls of the casing and they are preferably aligned vertically midway between the front and rear walls.

Referring to FIG. 2 take-up spindle 24 is journalled at one end in an opening 25 in side wall 13 and has a manual knob 26 outside wall 13. At its other end shaft 24 is formed with a ratchet toothed section 27 that is disposed within a hollow internally toothed boss 28 on removable side wall 14, these parts being interconnected in the annular zone designated at 29 by inclined teeth permitting rotation of spindle 24 in only one direction, clockwise in FIG. 1. Beyond the ratchet section spindle 24 returns to size and is journalled in wall opening 31, a suitable O-ring or the like at 32 providing a liquid tight seal. A similar seal may be provided at wall opening 25.

Spindle 23 may be simply rotatably mounted in the opposite side walls, but for some purposes a friction drag or even a ratchet like that shown in FIGS. 2 and 3 may be provided in one side wall as will appear.

Top wall 16 is formed with a transverse opening 33 within and along which extends a stationary anvil type backing member 34 that has an external arcuate convex, preferably cylindrical, smooth surface 35 that extends transversely all the way between the side walls 13 and 14. In practice member 34, which may be hollow may be molded integrally with the casing walls, and removable wall 14 abuts it at one end in assembly.

Preferably opening 33 is of considerable width to permit surface 35 to have a large radius uniform curvature where it projects above top wall 16. Advantageously surface 35 may be cylindrical with its axis substantially coincidental with that of spindle 23. As shown in FIG. 1 there are transverse clearances 36 and 37 at opposite sides of the member 34 and at one side wall 16 is formed along opening 33 with an inclined guide lip 38. Preferably also the edge 39 of member 34 extending parallel to lip 38 is rounded smoothly as shown.

A removable integral plastic closure cap 41 is mounted with a friction type fit on an upstanding ledge 42 on wall 16. Any suitable cap mounting is acceptable, but preferably it is as air tight as possible to prevent evaporation of the composition from the web section overlying surface 35.

In assembly, before side wall 14 is attached the supply roll 43 is mounted on spindle 23 and the leading end of the web 44 threaded through clearance 36, over surface 35, and through clearance 37 and slot 22 to be attached to spindle 24. For this purpose the extreme leading end may be coated with a sticky material to wind tight on the spindle, or the spindle may have a slot such as is used in microfilm reader arbors. In any event the web is made substantially taut between the supply roll and spindle 24 by rotating knob 26, and then side wall 14 is applied. It will be noted that when wall 14 is attached the web ends of spindles 23 and 24 slidably fit into the journals or ratchet connections already formed in wall 14.

Web 44 is a length of absorbent sheet material having a width about equal to the length of surface 35 which it closely overlies. Web 44 may be preimpregnated with a material such as a liquid deodorant composition; so that when the user removes cap 41 there will be accessible to him at the top of casing 10 an upstanding smoothly rounded, preferably cylindrical, moist surface area backed solidly by member 34. Thus the user grasps casing 10 as a handle and rubs the moist area over the body part to be treated.

After an application the user, or another user, may rotate knob 26 to dispose a fresh moist area overlying surface 35, and the applicator is ready to use again. The already used leading end of the web is wound in a roll on spindle 24, and since due to the one-way clutch spindle 24 may be rotated in only one direction there is no chance of an already used area of the web being moved into application position over surface 35. Eventually all of the web is used and becomes accummulated on spindle 24. The casing may be disposed of, or in some instances refilled by removing wall 14, extracting the rewound web and inserting and threading a fresh web.

Web 43 may be any cellulosic, paper or like fabric or sheet that is capable of absorbing and/or otherwise serving as a carrier for the composition that is to be applied by the applicator. A non-woven fabric may be used. In some instances the web may be a non-absorbent tape bearing on the surface which is exposed at member 34 a layer or other supply of the composition to be applied.

Figure 4:
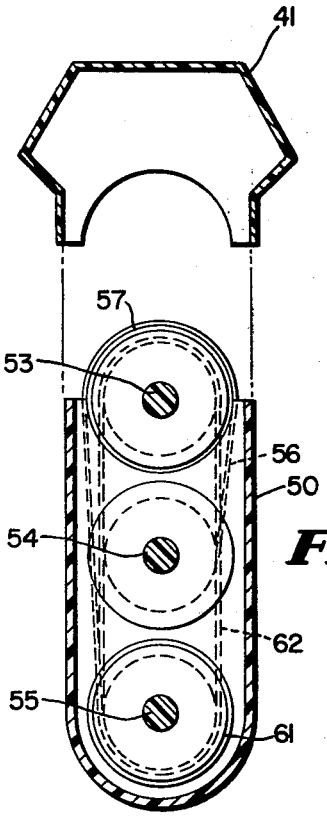
FIG. 4 is a side elevation mainly in section showing another embodiment.
Figure 5:
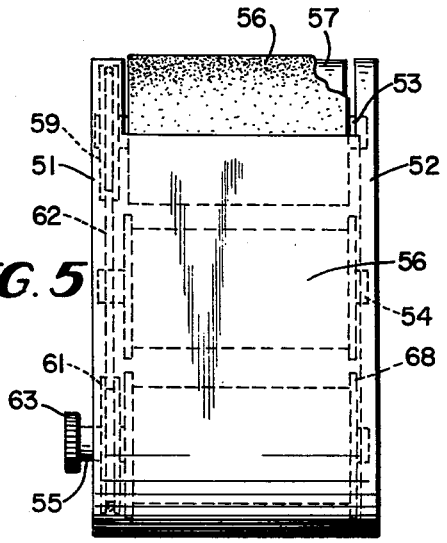
FIG. 5 is a front elevation of the embodiment of FIG. 4.

FIGS. 4 and 5 show another embodiment wherein the exposed carrier web section passes over a freely rotatable backing roller instead of a stationary backing surface. Here the casing 50 is generally U-shaped in section, with opposite side walls 51 and 52 in which are journalled spindles 53, 54 and 55 on spaced parallel axes.

Spindle 54 mounts a supply roll of the web 56 carrying the composition to be dispensed. Web 56 passes upwardly through the open top of the casing, over a smooth surfaced cylindrical roller 57 fixed on spindle 53, and downwardly into the casing where the leading end is secured to a rewind roller 58 on the spindle 55. As shown in FIG. 5, pulleys 59 and 61 are mounted on spindles 53 and 55 respectively within the casing 50 and a continuous drive belt 62 passes between the pulleys. Spindle 55 has an external manual knob 63, and spindle 55 is preferably mounted for unidirectional rotation as in FIGS. 1–3. A cap 41 normally encloses the exposed roller backed section of the web.

Figure 6:
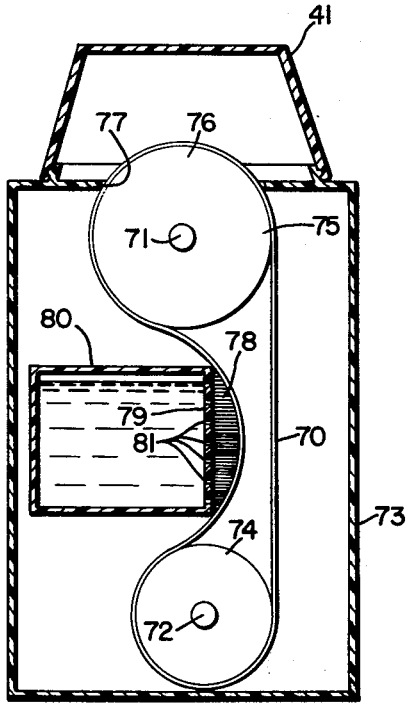
FIG. 6 is a side elevation in section showing another embodiment.

Referring to FIG. 6, an endless web applicator 70 is provided. Spindles 71 and 72 are mounted for rotation in the side walls of a casing 73. A cylindrical roller 74 is secured on spindle 72. A cylindrical backing roller 75 is secured on spindle 71, and an upper sector of roller 75 indicated at 76 extends through an opening 77 in the top wall of the casing. Thus the carrier web passing over rolls 74 and 75 exhibits an arcuate applicator surface backed by roller 76. Either spindle may have a unidirectional mounting as in FIGS. 1–3.

In this embodiment the web receives the treatment composition by engagement with a brushlike distributor member 78 that is mounted on a wall 79 of a fixed container 80 for the composition, wall 79 being apertured as at 81 to meter the supply of liquid to brush for wiping it onto the carrier. Thus the supply of a liquid on the carrier is renewable by rotating one of the spindles to move the web across brush 78.

A tight closure cap 41 encloses opening 77 and the upper sector of the rollor 75, similarly to FIG. 1.

The invention may be embodied in other specific forms without departing from the spirit or essential characteristics thereof. The present embodiments are therefore to be considered in all respects as illustrative and not restrictive, the scope of the invention being indicated by the appended claims rather than be the foregoing description, and all changes which come within the meaning and range of equivalency of the claims are therefore intended to be embraced therein.

What is claimed and desired to be secured by Letters Patent is:

1. Disposable apparatus for dispensing a fluent composition for personal body use comprising a casing having a top wall opening, a stationary web backing member extending across said casing with a sector thereof projecting through said opening, said sector having a smooth firm cylindrical surface extending externally of said casing about an axis within the casing, means in said casing below said member rotatably mounting a supply roll of a pre-treated carrier web bearing said composition, said supply roll being rotatable on an axis substantially coincident with the axis of said cylindrical surface and said web passing directly from said supply roll out through said opening at one side of said member to closely overlie said cylindrical surface of said member and present a firmly backed stationary applicator area outside said casing and then passing into said casing along the other side of said member, and web rewind means rotatably mounted in said casing below said supply roll located to directly receive said web and operable for displacing said web to selectively dispose a fresh area of web in overlying relation to said member, said web rewind means comprising a spindle having web attachment means and mounted for unidirectional rotation such that the web may be displaced only in the direction to provide a fresh exposed area overlying said cylindrical surface, and said casing being so constructed as to serve as a handle to be grasped by the user while rubbing the backed exposed web area over the part to be treated.

2. The apparatus defined in claim 1 wherein the opposite sides of said web backing member have small clearances with the adjacent side edges of said casing top wall opening so as to guide the web during movement into and out of the casing.

3. The apparatus defined in claim 2 wherein said member is integral with said casing top wall.

4. The apparatus defined in claim 1 wherein said casing top wall is formed with an upstanding ledge surrounding said opening and a cap having a snap fit on said ledge protectively encloses the exposed applicator area.

5. The apparatus defined in claim 1 wherein said casing comprises integral top, bottom, front and rear walls and one integral side wall, and a removable side wall for access to said supply roll and rewind means, and means on said removable side wall for supporting an end of said spindle and controlling the unidirectional movement of said web.

* * * * *